US006924745B2

(12) United States Patent
Schultz et al.

(10) Patent No.: US 6,924,745 B2
(45) Date of Patent: Aug. 2, 2005

(54) SYSTEM AND METHOD FOR MONITORING PACKER SLIPPAGE

(75) Inventors: Roger L. Schultz, Aubrey, TX (US); Gary D. Ellis, Richardson, TX (US); Russell I. Bayh, III, Carrollton, TX (US); Neal G. Skinner, Lewisville, TX (US)

(73) Assignee: Halliburton Energy Services, Inc., Duncan, OK (US)

( * ) Notice: Subject to any disclaimer, the term of this patent is extended or adjusted under 35 U.S.C. 154(b) by 587 days.

(21) Appl. No.: 10/171,025

(22) Filed: Jun. 13, 2002

(65) Prior Publication Data

US 2003/0231117 A1 Dec. 18, 2003

(51) Int. Cl.[7] ..... G01V 3/00

(52) U.S. Cl. ..... 340/856.3; 166/250.17; 166/387

(58) Field of Search ..... 340/856.3, 856.2, 340/854.1; 166/250.01, 250.17, 387; 73/152.57

(56) References Cited

U.S. PATENT DOCUMENTS

| | | | | |
|---|---|---|---|---|
| 4,067,349 A | | 1/1978 | Austin et al. | 138/97 |
| 4,206,810 A | | 6/1980 | Blackman | 166/336 |
| 4,426,882 A | | 1/1984 | Skinner | 73/155 |
| 4,506,731 A | | 3/1985 | Skinner | 166/113 |
| 4,508,174 A | | 4/1985 | Skinner et al. | 166/373 |
| 4,582,136 A | | 4/1986 | Skinner | 166/250 |
| 4,866,607 A | | 9/1989 | Anderson et al. | 364/422 |
| 4,999,817 A | | 3/1991 | Zimmer | 367/65 |
| 5,234,057 A | | 8/1993 | Schultz et al. | 166/319 |
| 5,236,048 A | | 8/1993 | Skinner et al. | 166/382 |
| 5,273,113 A | | 12/1993 | Schultz | 166/250 |
| 5,279,363 A | | 1/1994 | Schultz et al. | 166/53 |
| 5,293,937 A | | 3/1994 | Schultz et al. | 166/250 |
| 5,318,137 A | | 6/1994 | Johnson et al. | 175/40 |
| 5,332,035 A | | 7/1994 | Schultz et al. | 166/53 |
| 5,355,960 A | | 10/1994 | Schultz et al. | 166/374 |
| 5,367,911 A | | 11/1994 | Jewell et al. | 73/861.08 |
| 5,412,568 A | | 5/1995 | Schultz | 364/422 |
| 5,490,564 A | | 2/1996 | Schultz et al. | 166/374 |
| 5,517,854 A | * | 5/1996 | Plumb et al. | 73/152.59 |
| 5,899,958 A | | 5/1999 | Dowell et al. | 702/6 |
| 6,050,131 A | | 4/2000 | Willauer | 73/37 |
| 6,070,672 A | | 6/2000 | Gazda | 166/386 |
| 6,131,658 A | | 10/2000 | Minear | 166/250.01 |
| 6,144,316 A | | 11/2000 | Skinner | 340/853.7 |
| 6,229,453 B1 | | 5/2001 | Gardner et al. | 340/853.8 |
| 6,233,746 B1 | | 5/2001 | Skinner | 2/227.18 |
| 6,236,620 B1 | | 5/2001 | Schultz et al. | 367/82 |
| 6,257,332 B1 | | 7/2001 | Vidrine et al. | 166/250.15 |
| 6,273,189 B1 | | 8/2001 | Gissler et al. | 166/241.1 |
| 6,286,596 B1 | | 9/2001 | Schnatzmeyer et al. | 166/250.15 |
| 6,310,559 B1 | | 10/2001 | Laborde et al. | 340/853.2 |
| 6,321,838 B1 | | 11/2001 | Skinner | 166/250.01 |
| 6,328,119 B1 | | 12/2001 | Gillis et al. | 175/325.1 |
| 6,384,738 B1 | | 5/2002 | Carstensen et al. | 340/854.3 |
| 6,394,181 B2 | | 5/2002 | Schnatzmeyer et al. | 166/250.15 |
| 2001/0013410 A1 | | 8/2001 | Beck et al. | 166/65.1 |
| 2001/0013411 A1 | | 8/2001 | Beck et al. | 166/65.1 |
| 2001/0040033 A1 | | 11/2001 | Schnatzmeyer et al. | 166/250.15 |
| 2001/0042617 A1 | | 11/2001 | Beck et al. | 166/65.1 |
| 2001/0043146 A1 | | 11/2001 | Beck et al. | 340/855.8 |
| 2003/0188862 A1 | * | 10/2003 | Streich et al. | 166/250.01 |
| 2004/0112597 A1 | * | 6/2004 | Hamid et al. | 166/250.17 |
| 2004/0173363 A1 | * | 9/2004 | Navarro-Sorroche | 166/387 |

FOREIGN PATENT DOCUMENTS

| | | | |
|---|---|---|---|
| WO | WO 00/55475 | 9/2000 | E21B/49/00 |

* cited by examiner

*Primary Examiner*—Timothy Edwards
(74) *Attorney, Agent, or Firm*—John W. Wustenberg; Warren B. Kice

(57) ABSTRACT

A system and method for monitoring a device in a well, according to which a sensor associated with the device monitors any movement of the device in the well and outputs a corresponding signal. The signal is processed and transmitted to a remote location.

29 Claims, 1 Drawing Sheet

10
12
14
22
20
16
24
26
30
32
TELEMETRY DEVICE
MICROPROCESSOR
34

40
42
44
50
46
60
ACCLERATION INTEGRATOR
62
68
TELEMETRY DEVICE
VELOCITY INTEGRATOR
64
MICROPROCESSOR
66

SYSTEM AND METHOD FOR MONITORING PACKER SLIPPAGE

BACKGROUND

Downhole packers are commonly used in many oilfield applications for the purpose of sealing against the flow of fluid to isolate one or more portions of a wellbore for the purposes of testing, treating, or producing the well. The packers are suspended in the wellbore, or in a casing in the wellbore, from a tubing string, or the like, and are activated, or set, so that one or more packer elements engage the inner surface of the wellbore or casing. These packers also include one or more slips which, when set, are anchored to the inner surface of the wellbore to hold the packer in place.

However, after the packers have been set in the wellbore in the above manner, relative movement between the packer and the casing can occur which can adversely affect the performance of the packer.

Accordingly, what is needed is a system and method for monitoring the packer movement, or slippage.

DETAILED DESCRIPTION

Figure 1:
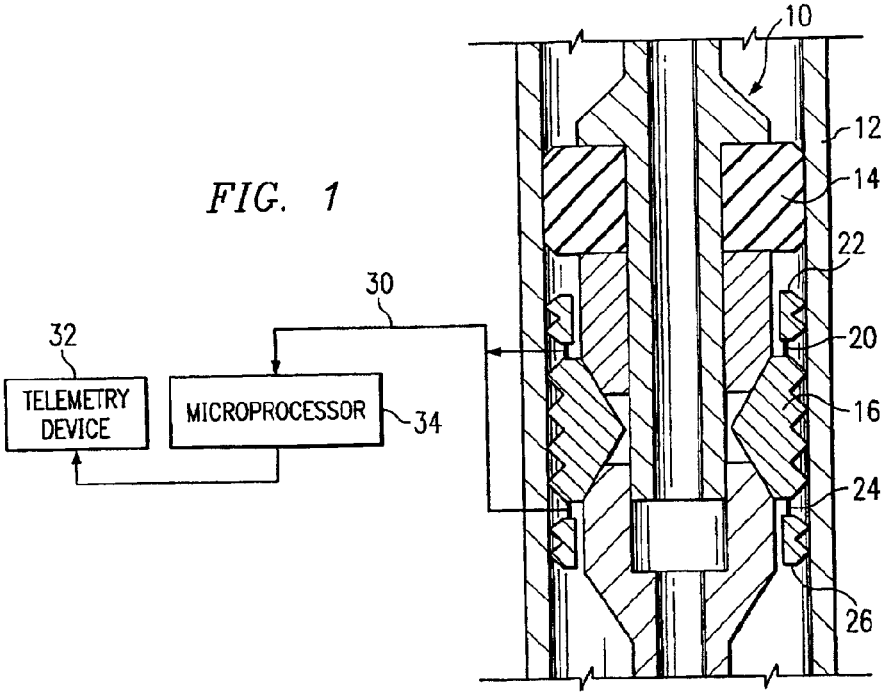
FIG. 1 is a diagrammatic view of a monitoring system for a packer installed in a casing according to an embodiment of the invention.

Referring to FIG. 1, a downhole tool is referred to, in general, by the reference numeral 10 and is shown installed in a casing 12 disposed in a well. The tool 10 is lowered to a predetermined depth in the casing 12 as part of a workstring, or the like, (not shown) which often includes other tools used to perform various oil recovery and completion operations. Since the tool 10 is conventional, it will not be described in detail.

The tool 10 includes a packer that consists of an annular packer element 14 and an annular slip 16 located downstream and slightly spaced from the packer element 14. The packer element 14 is located at a predetermined axial location in the casing 12 and is set, or activated, in a conventional manner which causes it to engage the inner surface of the casing 12 to seal against the flow of fluids and thus permit the isolation of certain zones in the well. Also as a result of the setting, the slip 16 "bites" into the inner surface of the casing 12 to anchor the packer to the casing 12. Since both the packer element 14 and the slip 16 are conventional, they will not be described in further detail.

A sensor 20 is disposed in the casing 12 just above the upper end of the slip 16, as viewed in FIG. 1, and is anchored to the casing 12 by an anchoring device 22. Similarly, a sensor 24 extends just below the lower end of the slip 16 and is anchored to the inner wall of the casing 12 by an anchoring device 26. The sensors 20 and 24 function in a conventional manner to sense axial movement of the slip 16, i.e., relative movement between the slip 16 and the casing 12, and output a corresponding electrical signal. The sensors 20 and 24 can be annular in shape as shown, or each sensor can consist of a plurality of modules that are angularly spaced around the slip 16.

An electronics package is provided that includes an electrical circuit shown, in general, by the reference numeral 30 that is electrically connected between the sensors 20 and 24 and a telemetry device, or unit 32 which can be located downhole or at the ground surface. A computer 34, or computing device, such as a microprocessor, or the like, is connected in the electrical circuit 30 and includes software containing a movement detection algorithm. The computer 34 can be also be located downhole or at the ground surface.

Thus, the signals from the sensors 20 and 24, which correspond to the position of the slip 16, are inputted to the computer 34, which outputs corresponding signals that correspond to whether or not there is any movement of the slip 16, and, if so, the amount of the movement. The telemetry device 32 receives the signals from the computer 34 and transmits or provides the signals to hardware located at the ground surface or at a downhole location for initiating corrective measures to compensate for any movement of the slip 16. The telemetry device 32 could be of a conventional type, such as EM, acoustic, hardwired, mudpulse, etc.

Thus, the system of the embodiment of FIG. 1 monitors movement, or slippage of the slip 16, and detects movement of the slip 16, or relative movement between the slip 16 and the casing 12, thus permitting corrective measures to be initiated.

Figure 2:
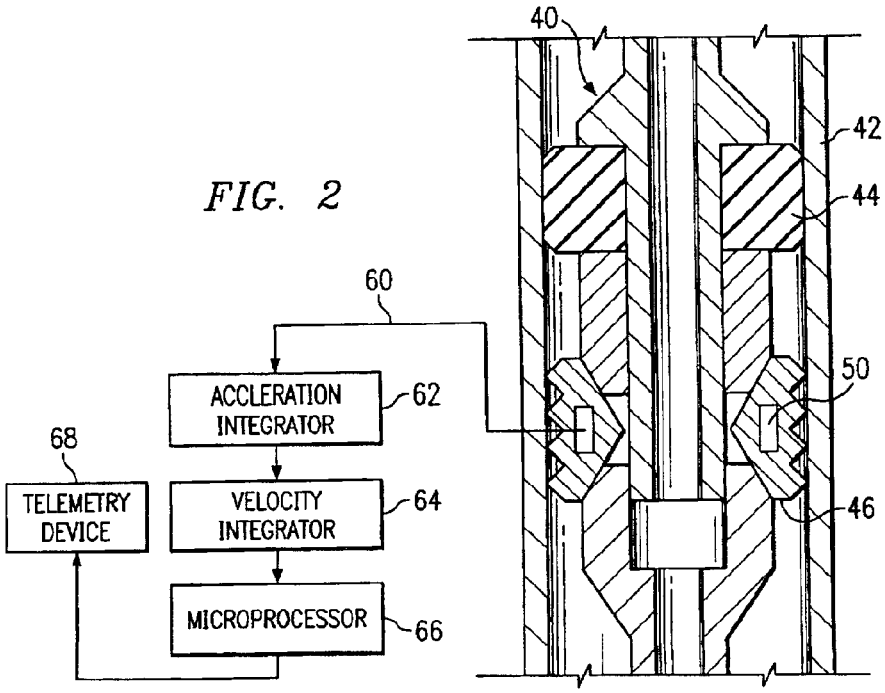
FIG. 2 is a view similar to that of FIG. 1 but depicting an alternate embodiment of a packer monitoring system.

Referring to the embodiment of FIG. 2, a downhole tool is referred to, in general, by the reference numeral 40 and is shown installed in a casing 42 disposed in a well. As in the case of the embodiment of FIG. 1, the tool 40 is lowered to a predetermined depth in the casing 42 as part of a workstring, or the like, (not shown) which often includes other tools used to perform various oil recovery and completion operations. Since the tool 40 is conventional, it will not be described in detail.

The tool 40 includes a packer that consists of an annular packer element 44 and an annular slip 46 located downstream and slightly spaced from the packer element 44. The packer element 44 is located at a predetermined axial location in the casing 42 and is set, or activated, in a conventional manner which causes it to engage the inner surface of the casing 42 to seal against the flow of fluids and thus permit the isolation of certain zones in the well. Also as a result of the setting, the slip 46 "bites" into the inner surface of the casing 42 to anchor the packer to the casing 42. Since both the packer element 44 and the slip 46 are conventional, they will not be described in further detail.

An accelerometer 50 is mounted on the slip 46 and functions in a conventional manner to sense acceleration of the slip 46. The accelerometer 50 can be annular in shape as shown, or can consist of a plurality of modules that are angularly spaced around the slip 46.

An electronics package is provided that includes an electrical circuit shown, in general, by the reference numeral 60, and including an acceleration integrator 62 and a velocity integrator 64 electrically connected between the acceleration integrator 62 and a computer 66, or computing system, such as a microprocessor, that includes software containing a movement detection algorithm. A telemetry device, or unit 68 is also provided which is connected to an output of the computer 66 for receiving a signal from the computer 66. As in the previous embodiment, the telemetry device 68 could be of a conventional type, such as EM, acoustic, hardwired, mudpulse, etc. Each of the acceleration integrator 62, the velocity integrator 64, the computer 66, and the telemetry device 68 can be located downhole or at the ground surface.

In operation, signals from the accelerometer 50, which correspond to any acceleration of the slip 46, are inputted to the acceleration integrator 62, which integrates the signals either in an analog domain or in a digital domain (using an analog to digital converter and a processor), to produce a signal corresponding to the velocity of the slip 46. The velocity integrator 64 receives the signals from the acceleration integrator 62 and integrates the signals in the above manner to produce signals corresponding to the displacement of the slip 46.

The signals from the velocity integrator 64 are inputted to the computer 66, which outputs corresponding signals that correspond to whether or not there is any movement of the slip 46 and, if so, the amount of the movement. The telemetry device 68 receives the signals from the computer 66 and functions to initiate corresponding corrective measures to compensate for any movement of the slip 46.

It should be noted that, under normal conditions, there will be many acceleration signals sensed and processed in the above manner, even though the slip 46 is not moving. However this does not present a problem since the computed displacement will be zero.

Thus, the system of the embodiment of FIG. 2 monitors acceleration of the slip 46, and produces an output signal corresponding to any movement of the slip 46, thus permitting corrective measures to be initiated.

Variations and Equivalents

It is understood that several variations may be made in the foregoing without departing from the scope of the invention. For example, the present invention is not limited to sensing of movement of the slips, but is equally applicable to other components of the packer, such as the packer elements. Also, the number of packer elements and slips used in both of the above embodiments can be varied within the scope of the invention. Further, the number of sensors used in the embodiment of FIG. 1 and the number of accelerators used in the embodiment of FIG. 2 can be varied within the scope of the invention. In addition, the sensors can be mounted on the outside of the packer or inside components of the packer such as the slips or packer elements. Moreover, both of the above embodiments are not limited to use with packers, but are equally applicable to other systems such as bridge plugs, service tools, liner hangers, or any other tool whose precise location in a wellbore is critical. Also, it is understood that spatial references, such as "axially", "radially", "downstream", etc. are for the purpose of illustration only and do not limit the specific spatial orientation or location of the components described above.

Still further, movement of the slips, the packer elements, or the packer in general, could be sensed by devices other than the devices disclosed above. For example, the sensing device could be in the form of a rolling element, such as a wheel, mounted on an arm to contact the inner diameter of the casing such that movement of the outer packer body parts would cause wheel rotation. A proximity sensor is mounted adjacent the wheel to count revolutions of the wheel and therefore movement of the packer relative to the casing.

An alternative sensing device is in the form of a collet type "feeler," which, when activated, would spring into position and engage the tubing/casing ID. A shoulder on the collet feeler is flanked by sensors above and below so that, if the packer moves, the feeler would remain in the initial position, and the respective upper or lower proximity sensor would indicate direction of movement.

Another form of the sensing device includes a movable contact component incorporated into the slip structure which deploys to the casing wall with the slip. Proximity sensors, disposed in the slip or in the component, monitor the position of the component relative to the slip body. Should the slip start to slide in the casing, the component would still be biased or loaded to the casing/tubing wall, and would not move relative to the slip, yet a response from the proximity sensors would be triggered. This device could also be incorporated into wedges or ramps associated with the packer.

Another embodiment of a sensing device utilizes a strain gauge imbedded in a slip support (in the form of a wedge or ramp) to monitor force transmitted between the slip and the slip support. As the load transmitted from the slip to the slip support reaches a near zero condition, slippage of the packer can occur since the slip teeth may not be engaged into the tubing/casing wall. The strain gauge could also be imbedded into the slip body to measure strain in the slip so that, as strain approaches zero, no load would be held by the slip. Another variant using strain measurement includes the use of a probe equipped with a strain monitoring sensor so that movement of the packer would cause the probe to bend, thereby increasing the strain in the probe.

Although only a few exemplary embodiments of this invention have been described in detail above, those skilled in the art will readily appreciate that many other modifications are possible in the exemplary embodiments without materially departing from the novel teachings and advantages of this invention. Accordingly, all such modifications are intended to be included within the scope of this invention as defined in the following claims.

What is claimed is:

1. A system for monitoring a device located in a well, the system comprising:

a sensor associated with the device for monitoring any movement of the device in the well, and for outputting a signal in response to any of the movement; and apparatus for receiving the signal from the sensor, processing the signal, and providing a signal corresponding to any movement of the device; wherein the device is located in a casing disposed in the well and wherein the sensor is anchored to the casing and senses relative movement between the device and the casing.

2. The system of claim 1 wherein the device is a slip portion of a packer.

3. The system of claim 1 wherein the apparatus comprises:

a computer for receiving the signal from the sensor and processing the signal; and a telemetry unit for receiving the processed signal from the computer and for initiating corrective measures to compensate for any movement of the device.

4. The system of claim 3 wherein the computer is located downhole.

5. The system of claim 3 wherein the computer is located at the ground surface.

6. A system for monitoring a device located in a well, the system comprising:

a sensor associated with the device for monitoring any acceleration of the device in the well and for outputting a signal in response to the acceleration; and at least one integrator electrically connected to the sensor for integrating the signal into another signal corresponding to any displacement of the device.

7. The system of claim 6 wherein the device is a slip portion of a packer.

8. The system of claim 6 wherein the at least one integrator comprises:

an acceleration integrator for integrating the signal received from the sensor to produce a signal corresponding to the velocity of the device; and a velocity integrator that receives the integrated signal from the acceleration integrator and integrates the signal further to produce a signal corresponding to the displacement of the device.

9. The system of claim 8 wherein the acceleration integrator is located downhole.

10. The system of claim 6 further comprising:

a computer for receiving and processing the signal corresponding to the displacement of the device; and a telemetry unit for receiving the processed signal from the computer and for transmitting the signal to a remote location.

11. The system of claim 10 where the signal from the telemetry unit is transmitted downhole or to the ground surface.

12. The system of claim 10 wherein the computer is located downhole.

13. The system of claim 6 further comprising apparatus for receiving the integrated signal, processing the integrated signal, and providing a signal corresponding to any displacement of the device.

14. The system of claim 13 wherein the apparatus comprises:

a computer for receiving and processing the integrated signal; and a telemetry unit for receiving the processed signal from the computer and transmitting the processed signal to another location.

15. The system of claim 14 wherein the telemetry unit is located downhole.

16. A method of monitoring a device in a well, the method comprising the steps of:

providing a sensor in the well for monitoring any movement of the device;

outputting a signal from the sensor in response to the movement;

integrating the signal; and compensating for the movement of the device in response to the integrated signal.

17. The method of claim 16 wherein the sensor is anchored to a casing disposed in the well and wherein the sensor is mounted on the outside of the device.

18. The method of claim 16 wherein the signal from the sensor is integrated into a velocity signal, and further comprising the step of integrating the velocity signal into a signal corresponding to displacement of the device.

19. The method of claim 18 further comprising the step of transmitting the signal corresponding to the displacement of the device to a remote location.

20. The method of claim 19 where the remote location is downhole or the ground surface.

21. The method of claim 16 wherein the sensor is mounted inside the device.

22. The method of claim 21 wherein the sensor is mounted inside a slip portion of the device.

23. A system for monitoring a device located in a well, the system comprising:

means for sensing any movement of the device in the well and for outputting a signal in response to the movement;

means for processing the signal corresponding to any movement of the device; and means for providing the processed signal to hardware for initiating corrective measures to compensate for the movement of the device.

24. The system of claim 23 wherein the means for sensing any movement of the device in the well and for outputting a signal in response to the movement comprises a sensor associated with the device for monitoring any acceleration of the device in the well and for outputting a signal in response to the acceleration.

25. The system of claim 24 wherein the means for processing the signal corresponding to any movement of the device comprises at least one integrator electrically connected to the sensor for integrating the signal into another signal corresponding to any movement of the device.

26. The system of claim 25 wherein the at least one integrator comprises:

an acceleration integrator for integrating the signal received from the sensor to produce a signal corresponding to the velocity of the device; and a velocity integrator that receives the integrated signal from the acceleration integrator and integrates the signal further to produce a signal corresponding to the movement of the device.

27. The system of claim 26 wherein the means for processing the signal corresponding to any movement of the device further comprises a computer located downhole.

28. The system of claim 27 wherein the means for providing the processed signal to hardware for initiating corrective measures to compensate for the movement of the device comprises a telemetry unit transmitting the processed signal downhole.

29. The system of claim 27 wherein the means for providing the processed signal to hardware for initiating corrective measures to compensate for the movement of the device comprises a telemetry unit transmitting the processed signal to the ground surface.

* * * * *